US008845307B2

(12) United States Patent
Kim et al.

(10) Patent No.: US 8,845,307 B2
(45) Date of Patent: Sep. 30, 2014

(54) MICRO-EJECTOR AND METHOD FOR MANUFACTURING THE SAME

(75) Inventors: Changsung Sean Kim, Gyunggi-do (KR); Sang Jin Kim, Gyunggi-do (KR); Suk Ho Song, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 374 days.

(21) Appl. No.: 12/929,635

(22) Filed: Feb. 4, 2011

(65) Prior Publication Data

US 2011/0293452 A1 Dec. 1, 2011

(30) Foreign Application Priority Data

May 25, 2010 (KR) ..... 10-2010-0048816

(51) Int. Cl.
*F04B 45/04* (2006.01)
*F04B 43/04* (2006.01)
*B01L 3/02* (2006.01)

(52) U.S. Cl.
CPC ..... *B01L 3/0268* (2013.01); *B01L 2400/086* (2013.01); *F04B 43/043* (2013.01)
USPC ..... 417/413.3

(58) Field of Classification Search
CPC ..... F04B 43/043; F04B 43/046
USPC ..... 417/413.2, 413.3, 413.1, 533
See application file for complete search history.

(56) References Cited

U.S. PATENT DOCUMENTS

| | | | | |
|---|---|---|---|---|
| 6,179,584 | B1 * | 1/2001 | Howitz et al. | 417/413.2 |
| 2004/0052657 | A1 * | 3/2004 | Van Lintel et al. | 417/322 |
| 2006/0028505 | A1 | 2/2006 | Ikegame | |
| 2008/0266360 | A1 * | 10/2008 | Yoo et al. | 347/54 |
| 2010/0167433 | A1 | 7/2010 | Lee et al. | |

FOREIGN PATENT DOCUMENTS

| | | | |
|---|---|---|---|
| DE | 100 00 691 | A1 | 7/2001 |
| DE | 102 20 371 | A1 | 11/2003 |
| JP | 61-114854 | | 6/1986 |
| JP | 11-129464 | | 5/1999 |
| JP | 2006-23259 | | 1/2006 |
| JP | 2008-30272 | | 2/2008 |
| JP | 2008-221825 | | 9/2008 |
| KR | 10-2007-0078201 | | 7/2007 |
| KR | 10-2008-0095337 | | 10/2008 |
| WO | 01/51208 | A1 | 7/2001 |
| WO | 03/095837 | A1 | 11/2003 |

OTHER PUBLICATIONS

Japanese Office Action dated Nov. 21, 2011 issued in corresponding Japanese Patent Application No. 10-2010-0048816.

(Continued)

*Primary Examiner* — Charles Freay
*Assistant Examiner* — Philip Stimpert

(57) ABSTRACT

There are provided a micro-ejector and a method for manufacturing the same. The micro-ejector according to the present invention includes a passage plate including a barrier rib portion disposed in an upper space in a chamber and a protruding portion disposed in a lower space in the chamber and forming a passage in the same direction as a fluid discharging direction together with the barrier rib portion; and an actuator formed on the upper portion of the passage plate to correspond to the chamber and providing a driving force of discharging the fluid to the nozzle from the chamber.

18 Claims, 5 Drawing Sheets

(56) References Cited

OTHER PUBLICATIONS

Japanese Office Action mailed Apr. 3, 2012 issued in corresponding Japanese Patent Application No. 2011-027775.
C.H. Cheng et al., "Multilevel electroforming for the components of a microdroplet ejector by UV LIGA technology", J. Micromech. Microeng. 15, 2005, pp. 843-848.
German Office Action issued Jun. 9, 2011 in corresponding German Patent Application 10 2011 005 471.5.

German Office Action mailed Feb. 27, 2013 for corresponding German Application No. 102011005471.5.

* cited by examiner

A-A'

B-B'

MICRO-EJECTOR AND METHOD FOR MANUFACTURING THE SAME

CROSS-REFERENCE TO RELATED APPLICATIONS

This application claims the priority of Korean Patent Application No. 10-2010-0048816 filed on May 25, 2010, in the Korean Intellectual Property Office, the disclosure of which is incorporated herein by reference.

BACKGROUND OF THE INVENTION

1. Field of the Invention

The present invention relates to a micro-ejector and a method for manufacturing the same, and more particularly, to a micro-ejector capable of easily discharging a fluid from a chamber to a nozzle by forming a plurality of passages in a chamber and reducing the height or the volume of the chamber and a method for manufacturing the same.

2. Description of the Related Art

The field of bio-technology, among all of the fields related to highly-developed modern technologies, has recently attracted a great deal of interest. Generally, since samples used in bio-technological research are mainly associated with the human body, a fine fluid system performing the role of transporting, controlling, and analyzing fine fluid samples existing in a state such that they are dissolved in a fluid or a fluid vehicle is an essential element within the field of bio-technology.

The micro fluid system uses micro electro mechanical systems (MEMS) technology. The micro fluid system is applied to fields, such as a technology of continuously injecting drugs such as insulin, or the like, or bioactive materials into a body, a lab-on-a-chip process, a chemical analysis technology for the development of new medicines, an inkjet printing technology, a small cooling system, a small fuel cell, or the like.

In the micro fluid system, a micro-ejector has been used as an essential element for fluid delivery. In particular, in the case of the micro-ejector for delivering biomedical materials, a micro-ejector using a piezoelectric element has mainly been used since fluids having strong viscosity and conductivity should be treated in consideration of the characteristics of the biomaterials.

In the case of the micro-ejector, when the change (driving energy) in pressure applied to a chamber due the change in displacement of the piezoelectric element is transferred to a nozzle, the height or volume of the chamber performs a damping role to lead to the loss of the driving energy, thereby degrading the discharge characteristics of the fluid.

SUMMARY OF THE INVENTION

An aspect of the present invention provides a micro-ejector capable of discharging a droplet at a desired rate or volume by reducing a space of a chamber and partitioning a passage in the chamber and a method for manufacturing the same.

According to an aspect of the present invention, there is provided a micro-ejector, including: a passage plate including a barrier rib portion disposed in an upper space in a chamber and a protruding portion disposed in a lower space in the chamber and forming a passage in the same direction as a fluid discharging direction together with the barrier rib portion; and an actuator formed on the upper portion of the passage plate to correspond to the chamber and providing a driving force of discharging the fluid to the nozzle from the chamber.

The width of the passage plate may be formed to be narrow in a direction from the chamber towards the nozzle.

The fluid passing through the passage formed by the barrier rib portion and the protruding portion in the chamber may be integrated in one passage to be supplied to the nozzle.

The width of the nozzle may be formed to be narrow in the fluid discharging direction.

The width of the nozzle may be formed to be narrow stepwise in the fluid discharging direction.

The barrier rib portion may include a guide portion guiding liquid flowing into or from the chamber at the longitudinal end thereof.

The actuator may be formed to correspond to each of the passages formed by the barrier rib portion and the protruding portion.

The passage plate may include an upper substrate and a lower substrate, the barrier rib portion may be formed on the upper substrate, and the protruding portion may be formed on the lower substrate.

The lower substrate may be formed by sequentially stacking a lower silicon layer, an insulating layer, and an upper silicon layer, and the protruding portion may be formed by the upper silicon layer.

According to an aspect of the present invention, there is provided a method for manufacturing a micro-ejector, including: preparing a passage plate having a passage of a fluid therein; forming a barrier rib portion in an upper space in a chamber delivering the fluid to a nozzle in the passage and forming a protruding portion forming the passage in the lower space of the chamber in the same direction as a fluid discharging direction, together with the barrier rib portion; and forming an actuator on the upper portion of the passage plate at a position corresponding to the chamber to provide a driving force of discharging the fluid to the nozzle from the chamber.

The preparing of the passage plate may form the width of the passage plate to be narrow in a direction from the nozzle towards the chamber.

The forming of the barrier rib portion and the protruding portion may integrate the fluid passing through the passage formed by the barrier rib portion and the protruding portion in the chamber in one passage to be supplied to the nozzle.

The method for manufacturing a micro-ejector may further include forming the width of the nozzle to be narrow in the fluid discharging direction.

The method for manufacturing a micro-ejector may further include forming the width of the nozzle to be narrow stepwise in the fluid discharging direction.

The forming of the barrier rib portion may form guide portion guiding liquid flowing into or from the chamber at the longitudinal end thereof.

The forming of the actuator may be formed to correspond to each of the passages formed by the barrier rib portion and the protruding portion.

The preparing of the passage plate may be made by preparing an upper substrate and a lower substrate, the forming of the barrier rib portion may be made by machining the upper substrate, and the forming of the protruding portion may be made by machining the lower substrate.

In the preparing of the lower substrate, a lower silicon layer, an insulating layer, and an upper silicon layer may be sequentially stacked, and the forming of the protruding portion may be accomplished by removing a portion other than a portion in which the protruding portion is formed from the upper silicon layer.

The method for manufacturing a micro-ejector may further include bonding the upper substrate to the lower substrate, wherein the bonding of the upper substrate to the lower substrate is accomplished by silicon direct bonding (SDB).

The method for manufacturing a micro-ejector may further include bonding the upper substrate to the lower substrate, wherein the bonding of the upper substrate to the lower substrate may bond the bottom surface of the upper substrate to the upper surface of the insulating layer on the lower substrate.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
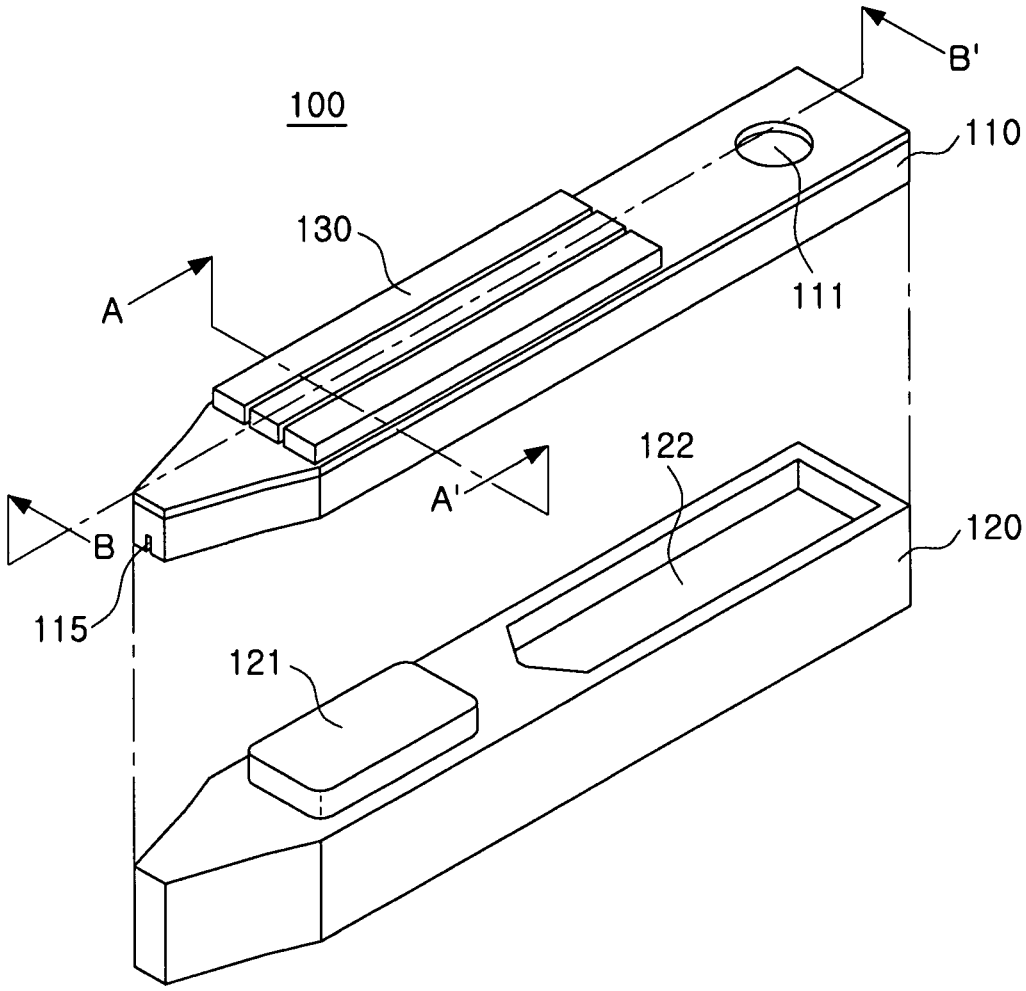
FIG. 1 is an exploded perspective view showing a micro-ejector according to an exemplary embodiment of the present invention.

Exemplary embodiments of the present invention will now be described in detail with reference to the accompanying drawings. However, it should be noted that the spirit of the present invention is not limited to the exemplary embodiments set forth herein and those skilled in the art and understanding the present invention can easily accomplish retrogressive inventions or other exemplary embodiments included in the spirit of the present invention by the addition, modification, and removal of components within the same spirit, but those are to be construed as being included in the spirit of the present invention.

In addition, components having like functions are denoted by like reference numerals throughout the drawings of each exemplary embodiment.

Figure 2:
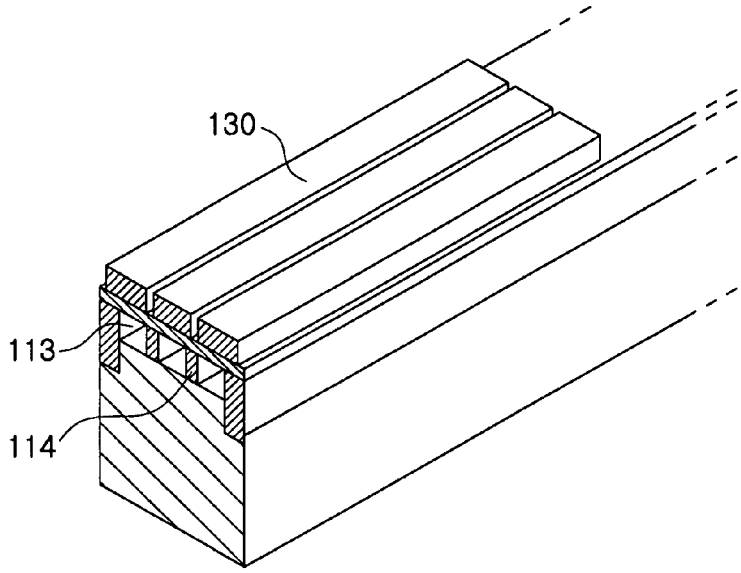
FIG. 2 is a vertical cross-sectional view of the micro-ejector taken along line A-A' of FIG. 1.
Figure 3:
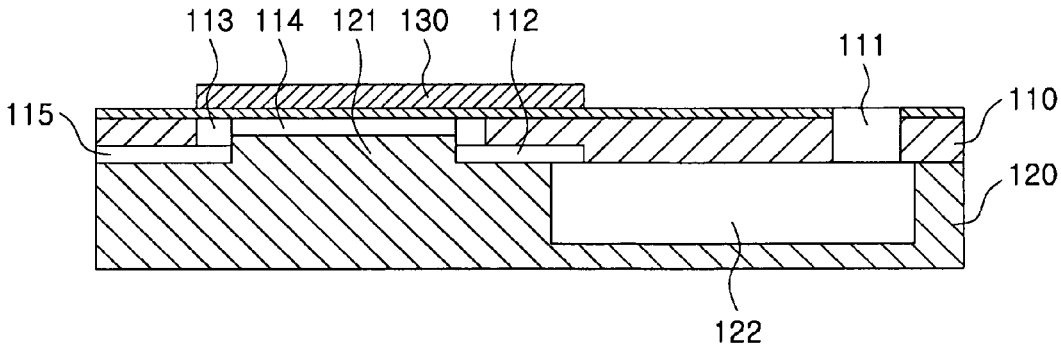
FIG. 3 is a vertical cross-sectional view of the micro-ejector taken along line B-B' of FIG. 1.

FIG. 1 is an exploded perspective view showing a micro-ejector according to an exemplary embodiment of the present invention, FIG. 2 is a vertical cross-sectional view of the micro-ejector taken along line A-A' of FIG. 1, and FIG. 3 is a vertical cross-sectional view of the micro-ejector taken along line B-B' of FIG. 1A.

Referring to FIGS. 1 to 3, a micro-ejector 100 according to an exemplary embodiment of the present invention includes an upper substrate 110 and a lower substrate 120 on which passages are formed and piezoelectric actuators 130 formed on the upper surface of the upper substrate 110. The upper substrate 110 and the lower substrate 120 may be formed so that the widths thereof become narrow in a direction towards a nozzle 115.

The upper substrate 110 may be formed with an inlet 111 into which a fluid is introduced, a groove for a restrictor 112, a groove for a chamber 113, and a groove for a nozzle 115. In this configuration, the upper substrate 110 may be a single crystalline silicon substrate and a silicon on insulator wafer (SOI) wafer having an insulating layer formed between two silicon layers. When the upper substrate 110 is the SOI wafer, the height of the chamber 113 may be substantially the same as the thickness of the lower silicon layer having two silicon layers.

Herein, when defining the direction of the micro-ejector, the thickness direction thereof implies a direction toward the lower substrate 120 from the upper substrate 110 or a direction opposite thereto, the length direction thereof implies a passage direction of the micro-ejector, i.e., a direction toward the nozzle 115 from the chamber 113 or a direction opposite thereto, the width direction thereof implies a direction perpendicular to the length direction. Further, the height implies the dimension of the thickness direction.

One or more barrier rib 114 is formed in the groove in which the chamber 113 of the upper substrate 110 is formed. A plurality of passages are formed in the chamber 113 by the barrier rib 114. That is, the fluid introduced into the chamber 113 through the restrictor 112 moves to three passages in the chamber partitioned by the barrier rib 114, and is collected in one passage at the portion of the nozzle 115 of the chamber 113 and is discharged to the nozzle 115. Although the exemplary embodiment describes the structure in which two barrier ribs 114 are formed and three passages are formed in the chamber 113, the present invention is not limited thereto and therefore, may be changed according to the required condition and design specifications.

The piezoelectric actuators 130 are formed on the upper portion of the upper substrate 110 to correspond to the chamber 113 and provide a driving force to discharge the fluid introduced into the chamber 113 to the nozzle 115.

In the exemplary embodiment of the present invention, the piezoelectric actuators 130 may be formed at positions corresponding to the passages in the chamber 113 partitioned by the barrier rib 114, respectively. That is, three piezoelectric actuators 130 may be formed at positions corresponding to three passages in the chamber 113, respectively.

The piezoelectric actuator 130 may be configured to include the lower electrode serving as a common electrode, a piezoelectric film deformed according to the applied voltage, and an upper electrode serving as a driving electrode.

The lower electrode may be formed over the surface of the upper substrate 110 and may be made of a conductive metal material, but may be preferably configured to include two metal thin film layers made of titanium (Ti) and platinum (Pt). The lower electrode serves as the common electrode as well as a diffusion prevention layer preventing the mutual diffusion between the piezoelectric film and the upper substrate 110.

The piezoelectric film is formed on the lower electrode and is disposed to be positioned on the upper portion of the chamber 113. This piezoelectric film may be made of a piezoelectric material, preferably, a lead zirconate titanate (PZT) ceramic material. The upper electrode is formed on the piezoelectric film and may be made of any one of materials such as Pt, Au, Ag, Ni, Ti, and Cu, or the like.

Although the exemplary embodiment of the present invention describes, by way of example, a structure in which the fluid is discharged by the piezoelectric driving scheme using the piezoelectric actuator 130, the present invention is not limited to the fluid discharging scheme but may be configured to discharge the fluid in various schemes, such as a thermal driving scheme, or the like, according to the required conditions.

The lower substrate 120 may be provided with a groove for a reservoir 122 delivering the fluid introduced into the inlet 111 to the chamber 113 and a protruding portion 121 disposed in the space of the chamber 113.

The lower substrate 120 may be a single crystalline silicon substrate or an SOI wafer but is preferably an SOI wafer formed by sequentially stacking the lower silicon layer 120*a*, the insulating layer 120*b*, and the upper silicon layer 120*c*.

The horizontal section of the protruding portion 121 may be formed to have a rectangular shape, which is only by way of example. Therefore, the horizontal section of the protruding portion 121 may be formed to have various forms such as a parallelogram shape or an extended hexagonal shape, or the like. The height of the protruding portion 121 is substantially the same as the thickness of the upper silicon layer and may be 10 to 100 μm according to the required height of the chamber. In this configuration, the height of the protruding portion may be set to be 100 μm or more if it there is no problem in patterning in connection with the structure of the other fluid passages.

The upper surface of the protruding portion 121 is disposed to contact the lower surface of the barrier rib portion 114 formed in the chamber 113, such that the passage is formed in the same direction as the discharging direction of the fluid in the chamber 113 together with the barrier rib portion 114. In addition, the protruding portion 121 is disposed to protrude into the chamber 113 to partition the passage in the chamber 113 into the plurality of portions while reducing the height of the chamber 113.

The method for manufacturing the micro-ejector according to the exemplary embodiment of the present invention will now be described below with reference to FIGS. 4 and 5.

FIG. 4 is a process diagram showing a method of forming a passage on an upper substrate of the micro-ejector according to the exemplary embodiment of the present invention and FIG. 5 is a process diagram showing a method of forming an ink passage on a lower substrate of the micro-ejector according to the exemplary embodiment of the present invention.

First, an exemplary manufacturing method according to the present invention will be briefly described. The passages are formed on the upper substrate and the lower substrate and the upper substrate is stacked on the lower substrate to be bonded to each other, thereby completing the micro-ejector according to the exemplary embodiment of the present invention. Meanwhile, the processes of forming the passages on the upper substrate and the lower substrate may be performed regardless of order. That is, the passage may be formed on any one of the upper substrate and the lower substrate and the passage may be formed on both the upper and lower substrate. However, for convenience of explanation, the process of forming the passage on the upper substrate will be described first.

Figure 4A:
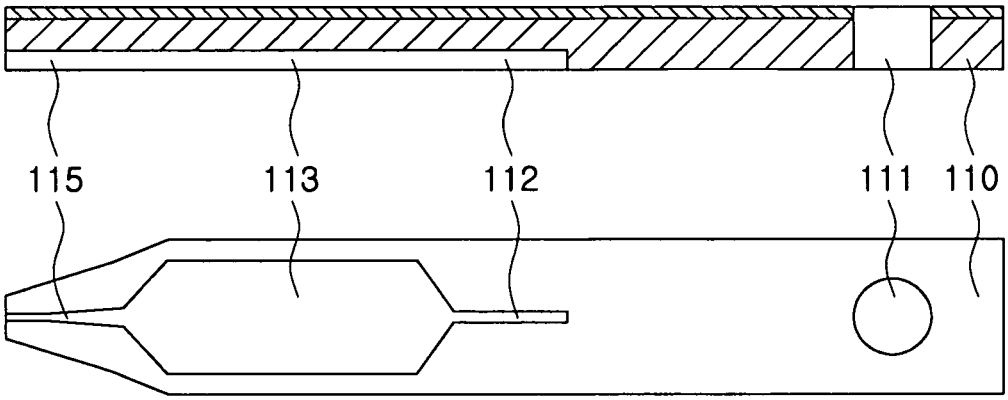
FIGS. 4A and 4B are process diagrams showing a method of forming a passage on an upper substrate of the micro-ejector according to the exemplary embodiment of the present invention.

Referring to FIG. 4A, the exemplary embodiment uses the silicon wafer having a thickness of approximately 100 to 200 μm as the upper substrate 110. Silicon oxide layers having a thickness of approximately 5,000 to 15,000 Å may be formed on the upper and lower surfaces of the upper substrate 110 by wet and/or dry-oxidizing the prepared upper substrate 110.

The grooves for forming the restrictor 112, the lower portion of the chamber 113, and the nozzle 115 and a through hole for forming the inlet 111 are formed on the lower surface of the upper substrate 110. It is preferable that the width of the upper substrate 110 is formed to be narrow in a direction towards the nozzle 115. In the groove, it is preferable that the portion formed with the nozzle 115 is formed to have a narrow width in the fluid discharging direction. Although in the exemplary embodiment, the width is formed to be reduced stepwise but the aspect of narrowing the width is specifically not limited.

The groove and the through hole may be formed on the upper substrate 110 by applying a photoresist on the lower surface of the upper substrate 110, patterning the applied photoresist, and being etched using the patterned photoresist as an etch mask, In this case, the patterning of the photoresist may be formed by a widely known photolithography method including exposure and development and the patterning of other photoresists to be described below may also be formed in a similar method.

In addition, the etching for forming the passage on the upper substrate 110 may be performed by a dry etching method such as reactive ion etching using an inductive coupled plasma (ICP) and a wet etching method using, for example, Tetramethyl Ammonium Hydroxide (TMAH) or potassium hydroxide (KOH) as a silicon etchant. The etching of the silicon wafer may be similarly applied to the etching for other silicon wafers to be described below.

Figure 4B:
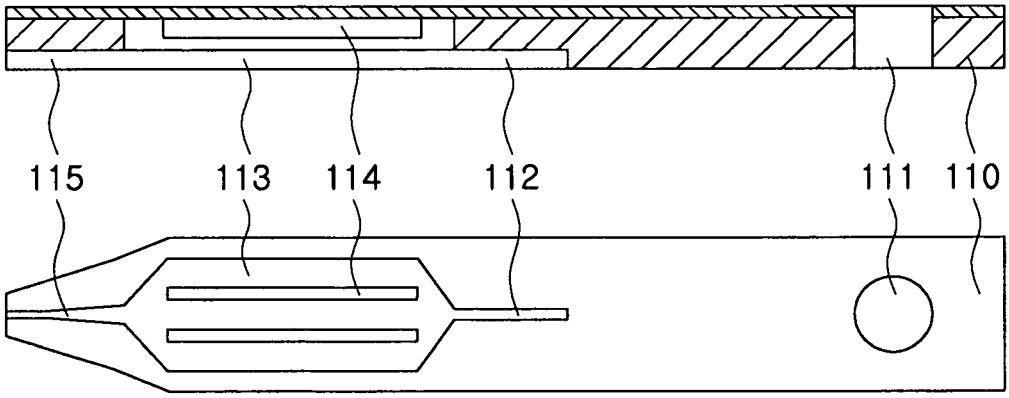

Next, as shown in FIG. 4B, the silicon wafer is etched in order to form the upper portion of the chamber 113. In this case, when the upper substrate 110 is an SOI wafer having an insulating layer formed between two silicon layers, the insulating layer serves as an etch stopping layer.

In this case, a portion other than a portion for forming the barrier rib 114 is etched so that the barrier rib 114 is formed in the inner space of the chamber 113.

The process of forming the passage on the lower substrate of the micro-ejector according to the exemplary embodiment of the present invention will be described with reference to FIGS. 5A and 5B.

Figure 5A:
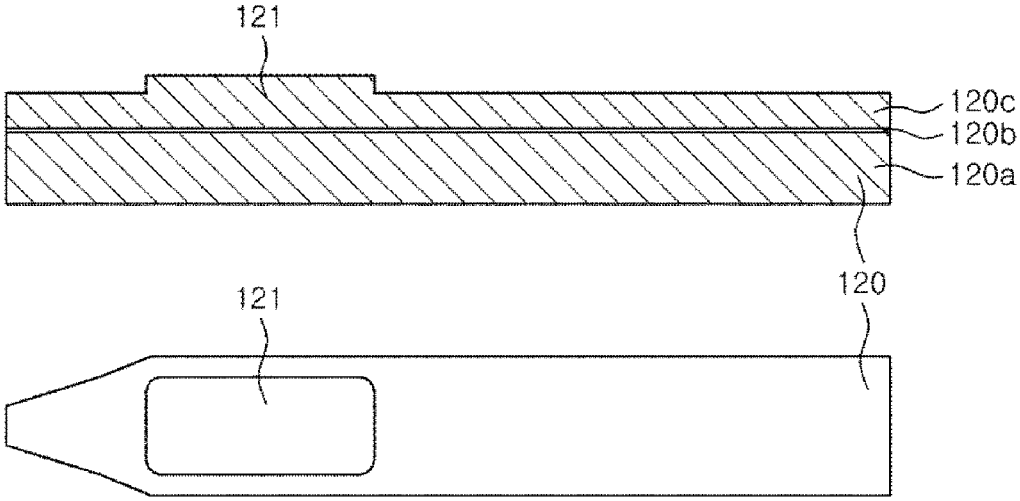
FIGS. 5A and 5B are process diagrams showing a method of forming an ink passage on a lower substrate of the micro-ejector according to the exemplary embodiment of the present invention.

As shown in FIG. 5A, as the lower substrate 120, the SOI wafer configured to include the lower silicon layer 120*a* having a thickness of approximately several hundreds μm, preferably, approximately 210 μm, the insulating layer 120*b* having a thickness of approximately 1 μm to 2 μm, and the upper silicon layer 120*c* having approximately 10 μm to 100 μm is used. The silicon oxide layers having a thickness of approximately 5,000 to 15,000 Å may be formed on the upper and lower surfaces of the lower substrate 120 by wet and/or dry-oxidizing the prepared lower substrate 120.

After the photoresist is applied to the upper surface of the lower substrate 120, in particular, the upper surface of the upper silicon layer and a portion other than a portion for forming the protruding portion 121 in the photoresist is removed, the upper silicon layer on the exposed portion is etched by using the photoresist as the etch mask. In this case, the etching of the upper silicon layer for forming the protruding portion 121 depends on the wet etching using TMAH or KOH or the dry etching method such as RIE using ICP.

The horizontal section of the protruding portion 121 may be formed in a rectangular shape or a parallelogram shape, etc., and the protruding portion 121 having a rectangular section may be obtained by dry-etching the upper silicon layer and the protruding portion 121 having a parallelogram section may be obtained by wet etching the upper silicon layer. In addition, they may be formed to have various shapes such as hexagonal shape having two long sides facing each other or an oval shape, or the like.

Since the protruding portion 121 is formed by etching the upper silicon layer, it has substantially the same height as the thickness of the silicon layer and the height of the protruding portion 121 may be variously adjusted by adjusting the thickness of the upper silicon layer. The height of the chamber 113 may also be adjusted according to the adjusted height of the protruding portion 121.

The photoresist existing on the upper surface of the formed protruding portion 121 may be removed by wet etching or dry etching and may also be removed by chemical mechanical planarization (CMP). The height of the protruding portion 121 may be adjusted by removing a part of the thickness of the protruding portion 121 together.

Figure 5B:
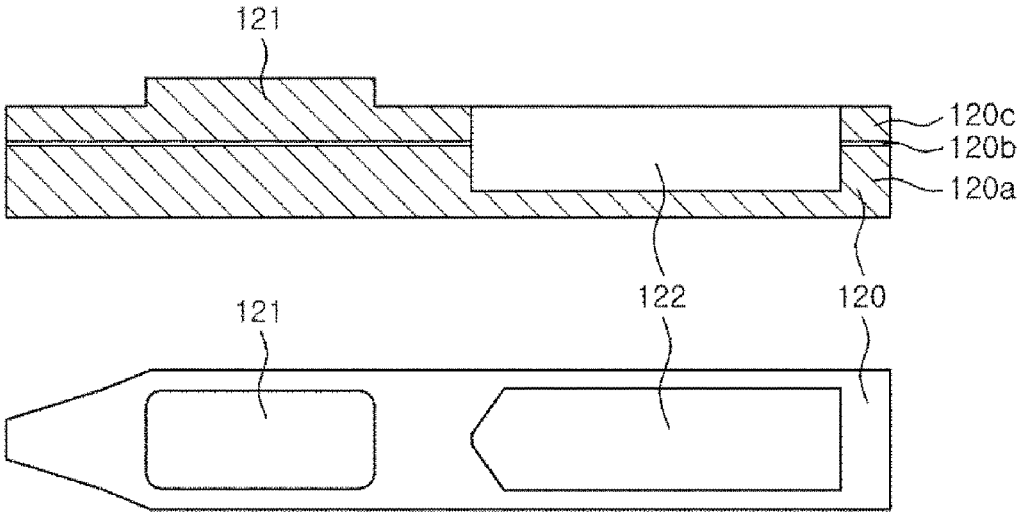

Next, as shown in FIG. 5B, the groove for the reservoir 122 is formed on the lower substrate 120 formed with the protruding portion 121. This photoresist is applied to cover the upper surface of the lower substrate 120, that is the upper surface of the insulating layer 120*b* and the upper surface of the protruding portion 121 and is patterned to form the opening portion for forming the reservoir 122 and then, the insulating layer 120*b* and a part of the lower silicon layer 120*a* are etched by using the patterned photoresist as the etch mask to form the groove for the reservoir 122. The groove for the reservoir 122 may be formed by the dry etching method or the wet etching method and the side of the reservoir 122 may be etched to be inclined.

Although the exemplary embodiment describes that the passage is formed by using the SOI wafer as the lower substrate 120, the single crystalline silicon substrate may be used as the lower substrate 120. That is, the single crystalline silicon substrate having the thickness of approximately 100 to 200 μm is prepared and then, the groove for the protruding portion 121 or the reservoir 122 may be formed on the lower substrate 120 in the same method as the method shown in FIGS. 5A and 5B.

When the upper substrate 110 and the lower substrate 120 on which the passages are formed are bonded to each other and the piezoelectric actuator 130 is positioned at the position corresponding to the chamber 113 on the upper surface of the upper substrate 110, the micro-ejector according to the exemplary embodiment is completed as shown in FIG. 1.

In this case, it is preferable that the bonding of the upper substrate 110 and the lower substrate 120 is made by the silicon direct bonding (SDB). That is, the lower surface of the upper substrate 110 and the upper surface of the insulating layer of the lower substrate 120 are used as the bonding surfaces and these bonding surfaces may be adhered to each other and then, heat-treated to be bonded.

The piezoelectric actuator 130 may be formed on the upper surface of the upper substrate 110 as the piezoelectric unit but may be a plurality of piezoelectric units formed at the positions corresponding to each of the plurality of passages formed by the barrier rib 114 and the protruding portion 121 in the chamber 113. That is, in the exemplary embodiment, three piezoelectric units may be formed to correspond to the spaces of the chamber 113 partitioned by the barrier rib 114.

Figure 6:
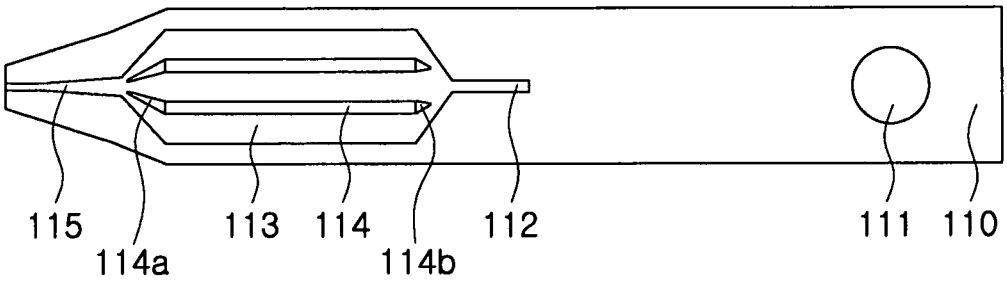
FIG. 6 is a bottom diagram showing an upper substrate of a micro-ejector according to another exemplary embodiment of the present invention.

FIG. 6 is a bottom diagram showing an upper substrate of a micro-ejector according to another exemplary embodiment of the present invention.

The micro-ejector according to another exemplary embodiment shown in FIG. 6 includes at least one guide portion guiding the flowing into or from the chamber at a longitudinal end of the barrier rib. The other components are the same as the micro-ejector according to the exemplary embodiment of the present invention shown in FIG. 1 and therefore, the detailed description thereof will be omitted. Therefore, the difference between these components will be described below.

Referring to FIG. 6, in the micro-ejector according to another exemplary embodiment of the present invention, guide portions 114*a* and 114*b* are installed in the longitudinal end of the micro-ejector in the barrier rib 114 in the chamber 113.

The barrier rib 114 may include a first guide portion 114*b* guiding the fluid delivered from the restrictor 112 into the chamber 113 to each of the plurality of passages partitioned by the barrier rib 114 and a second guide portion 114*a* guiding the fluid delivery from each of the plurality of passages partitioned by the barrier rib 114 to the nozzle 115.

The ends of the first and second guide portions 114*a* and 114*b* may be sharply formed in a direction towards the restrictor 112 and the nozzle 115. This is to facilitate the fluid delivery to the partitioned space in the chamber 113 by the first guide portion 114*b* and the fluid delivery to the nozzle 115 by the second guide portion 114*a*.

Although the exemplary embodiment describes that the first and second guide portions 114*a* and 114*b* are formed at both ends in the length direction of the barrier rib 114, respectively, in the present invention, the guide portion may be formed at only one end in the length direction of the micro-ejector.

The following Table 1 shows the fluid discharging characteristics of the micro-ejector according to the present invention and the micro-ejector according to the comparative example. The micro-ejector according to the present invention has a configuration capable of reducing the height of the chamber by forming the barrier rib portion and the protruding portion in the chamber and the micro-ejector according to the comparative example has the chamber configuration according to the related art. For these micro-ejectors, the discharging rate of the fluid and the volume of the discharging droplet were measured. In this case, the displacement of the piezoelectric actuator was set to be 120 nm.

TABLE 1

| | Example | Comparative Example |
|---|---|---|
| Chamber Height (μm) | 70 | 130 |
| Discharging Rate (m/s) | 3.86 | 0.95 |
| Droplet volume (pL) | 149 | 95.2 |

As shown in Table 1, the micro-ejector according to the example of the present invention reduces the height of the chamber and partitions the space of the chamber into the plurality of portions, such that it can be confirmed that the droplet volume is increased by about 1.56 times and the discharging rate is increased by about 4 times, as compared to the Comparative Example. The reason for this is that the loss of the driving energy (the change in pressure) transferred to the outlet of the nozzle is reduced by the change in displacement of the piezoelectric actuator. That is, the reason is that the Comparative Example generates the damping of the driving energy transferred to the outlet of the nozzle corresponding to the height or volume of the camber, thereby increasing the loss of the driving energy.

As set forth above, according to the micro-ejector and the method for manufacturing the same according to the exemplary embodiments of the present invention, the space of the chamber is reduced and the plurality of passages are formed in the chamber, thereby making it possible to improve the fluid discharging characteristics, such as the fluid discharging rate or volume of the micro-ejector.

While the present invention has been shown and described in connection with the exemplary embodiments, it will be apparent to those skilled in the art that modifications and variations can be made without departing from the spirit and scope of the invention as defined by the appended claims.

What is claimed is:

1. A micro-ejector, comprising:

an upper substrate including a groove for a chamber, and a barrier rib portion formed downwardly in a thickness direction within the groove in which the chamber of the upper substrate is formed, the barrier rib portion forming a plurality of passages in the chamber by partitioning an inner space of the chamber;

a lower substrate coupled to the upper substrate, the lower substrate including a protruding portion protruding upwardly from an upper surface of the lower substrate, having an upper surface in contact with a lower surface of the barrier rib portion within the chamber, and forming the passages in a fluid discharging direction together with the barrier rib portion; and at least one actuator disposed on an upper surface of the upper substrate to correspond to the passages and providing a driving force of discharging the fluid from the chamber to a nozzle.

2. The micro-ejector of claim 1, wherein the widths of the upper substrate and the lower substrate are formed to be narrow in a direction towards the nozzle from the chamber.

3. The micro-ejector of claim 1, wherein the fluid, passing through the passages formed by the barrier rib portion and the protruding portion in the chamber, is integrated in one passage to be supplied to the nozzle.

4. The micro-ejector of claim 1, wherein the width of the nozzle is formed to be narrow in the fluid discharging direction.

5. The micro-ejector of claim 1, wherein the width of the nozzle is formed to be narrow stepwise in the fluid discharging direction.

6. The micro-ejector of claim 1, wherein the barrier rib portion includes a guide portion disposed at a longitudinal end thereof and guiding the fluid to flow into or out of the chamber.

7. The micro-ejector of claim 1, wherein the actuators are formed above each of the passages formed by the barrier rib portion and the protruding portion.

8. The micro-ejector of claim 1, wherein the lower substrate is formed by sequentially stacking a lower silicon layer, an insulating layer, and an upper silicon layer, and the protruding portion is formed by the upper silicon layer.

9. A method for manufacturing a micro-ejector, comprising:

preparing an upper substrate having a groove for a chamber therein and a lower substrate;

forming a barrier rib portion in the groove in order to form a plurality of passages in the chamber by partitioning an inner space of the chamber and forming a protruding portion on the lower substrate, the protruding portion disposed to be in contact with the barrier rib portion in the chamber and forming the passages in the same direction as a fluid discharging direction, the forming the barrier rib portion in the groove being performed by etching portions of the upper substrate, other than a portion thereof for forming the barrier rib portion, such that the barrier rib portion is formed in an inner space of the chamber, and the forming the protruding portion on the lower substrate being performed by removing portions thereof other than portions thereof to be formed as the protruding portion; and forming at least one actuator on the upper surface of the upper substrate to correspond to the passages, the at least one actuator providing a driving force for discharging the fluid from the chamber to a nozzle.

10. The method for manufacturing the micro-ejector of claim 9, wherein the preparing of the upper substrate and the lower substrate comprises forming the widths thereof to be narrowed in a direction towards the nozzle from the chamber.

11. The method for manufacturing the micro-ejector of claim 9, wherein the forming of the barrier rib portion and the protruding portion comprises allowing the fluid, passing through the passages formed by the barrier rib portion and the protruding portion in the chamber, to be integrated in one passage to be supplied to the nozzle.

12. The method for manufacturing the micro-ejector of claim 9, further comprising forming a width of the nozzle to be narrowed in the fluid discharging direction.

13. The method for manufacturing the micro-ejector of claim 9, further comprising forming a width of the nozzle to be narrowed in a stepwise manner in the fluid discharging direction.

14. The method for manufacturing the micro-ejector of claim 9, wherein the forming of the barrier rib portion comprises forming a guide portion disposed at a longitudinal end thereof and guiding the fluid to flow into or out of the chamber.

15. The method for manufacturing the micro-ejector of claim 9, wherein the forming of the actuators comprises forming the actuators above each of the passages formed by the barrier rib portion and the protruding portion.

16. The method for manufacturing the micro-ejector of claim 9, wherein the preparing of the lower substrate is performed by sequentially stacking a lower silicon layer, an insulating layer, and an upper silicon layer.

17. The method for manufacturing the micro-ejector of claim 9, further comprising bonding the upper substrate to the lower substrate, wherein the bonding of the upper substrate to the lower substrate is made by silicon direct bonding (SDB).

18. The method for manufacturing the micro-ejector of claim 9, further comprising bonding the upper substrate to the lower substrate, wherein the bonding of the upper substrate and the lower substrate is performed by bonding a bottom surface of the upper substrate to an upper surface of the insulating layer of the lower substrate.

* * * * *